US005993238A

United States Patent [19]

Kudo et al.

[11] Patent Number: 5,993,238

[45] Date of Patent: Nov. 30, 1999

[54] HALF-FITTING PREVENTION CONNECTOR

[75] Inventors: Toshiharu Kudo; Tsuyoshi Hamai; Takayoshi Endo; Takashi Ishii, all of Shizuoka, Japan

[73] Assignee: Yazaki Corporation, Tokyo, Japan

[21] Appl. No.: 08/992,879

[22] Filed: Dec. 17, 1997

[30] Foreign Application Priority Data

Dec. 19, 1996 [JP] Japan ..... 8-340011

[51] Int. Cl.[6] ..... H01R 13/62

[52] U.S. Cl. ..... 439/352

[58] Field of Search ..... 439/188, 352, 439/353, 351, 357, 358, 488, 489, 345.7

[56] References Cited

U.S. PATENT DOCUMENTS

| | | | |
|---|---|---|---|
| 5,183,410 | 2/1993 | Inaba et al. | 439/489 |
| 5,217,385 | 6/1993 | Inoue et al. | 439/353 |
| 5,848,912 | 12/1998 | Okabe | 439/489 |

FOREIGN PATENT DOCUMENTS

| | | |
|---|---|---|
| 0 097 089 | 12/1983 | European Pat. Off. . |
| 41 30 543 C2 | 3/1992 | Germany . |
| 196 54 287 | 7/1997 | Germany . |
| 5-81967 | 11/1993 | Japan . |
| 2 308 755 | 7/1997 | United Kingdom . |

*Primary Examiner*—Lincoln Donovan
*Assistant Examiner*—Eugene G. Byrd
*Attorney, Agent, or Firm*—Sughrue, Mion, Zinn Macpeak & Seas, PLLC

[57] ABSTRACT

An half-fitting prevention connector includes a pair of female and male connectors to be fitted and connected to each other, an elastic member disposed in a housing of one of said female and male connectors, a repulsion force of said elastic member preventing said female and male connectors from half-fitting to each other, a lock member disposed in said housing so as to be slidable in a direction of mutual fitting of said female and male connectors for locking the other one of said female and male connector in said housing on the basis of function of said elastic member; and a support mechanism for supporting said lock member so that said lock member is slidable in said housing.

16 Claims, 15 Drawing Sheets

HALF-FITTING PREVENTION CONNECTOR

BACKGROUND OF THE INVENTION

1. Field of the Invention

The present invention relates to an half-fitting prevention connector set in which not only the mutual fitting of female and male connectors is released by the repulsion force of an elastic member when the female and male connectors are left in an half-fitted state but also the female and male connectors are locked securely when they are perfectly fitted to each other.

2. Related Art

Conventionally, various connector sets are known as half-fitting prevention connector sets. For example, an half-fitting prevention connector set disclosed in JU-A-5-81967, or the like, is known.

As shown in FIGS. 15 and 16, a pin-side connector 100 has a plurality of pin contacts 102 arrayed in its inside, and mount flanges 100*a* provided in opposite side portions. A socket-side connector 101 has a plurality of socket contacts 103 arrayed in its inside, and electric wires 103*a* connected to the socket contacts 103 respectively, as shown in FIG. 16.

The pin-side connector 100 has a box-like housing 104 having an opened front portion. Guide plates 105 for guiding the pin-side connector 100 to be fitted to the socket-side connector 101 are provided in the inside of the housing 104 so as to partition the inside, at the center, into upper and lower parts. As shown in FIG. 16, the pin contacts 102 are provided in the inside of the housing 104 so as to project forward from the rear portion. A notch 104*e* is provided in the center portion of a cover plate 104*d* provided on the upper portion of the housing 104. An engagement piece 106 is formed in front of the notch 104*e* integrally with the cover plate 104*d*. A front end of the engagement piece 106 is set back from the front end edge of the housing 104 and has such flexibility as to be able to be curved slightly upward. An engagement protrusion 106*a* is provided at an end portion of the engagement piece 106 so as to project inward.

The socket-side connector 101 has a box-like housing 107 which has such a size that the housing 107 can be fitted into the opening of the housing 104 of the pin-side connector 100. Pin holes 108 into which the pin contacts 102 are to be inserted and slots 109 into which the guide plates 105 are to be inserted are provided in the front portion of the housing 107.

The outside of the housing 107 is covered, except its front and rear portions, with a movable cover 110 so that the movable cover 110 can move back and forth. An opening portion 111 for insertion of the socket-side connector 100 is provided in the front portion of the movable cover 110. The opening portion 111 has a size which is large enough so that a pair of opposite side plates 104*a*, a ceiling plate 104*b* and a bottom plate 104*c* of the housing 104 of the pin-side connector 100 can be inserted into the opening portion 111. However, when the engagement protrusion 106*a* of the engagement piece 106 abuts on the front end surface of the housing 107 and the engagement piece 106 is bent outward, the front end of the engagement piece 106 strikes the edge of the opening portion 111 so that the opposite side plates 104*a*, the ceiling plate 104*b* and the bottom plate 104*c* cannot be inserted into the opening portion 111.

Spring receiving portions (not shown) are provided so as to be opposite to each other in the opposite side portions of the housing 107 and the movable cover 110. Springs 114 are disposed in the spring receiving portions respectively so as to be extended in the front-rear direction, as indicated by the dot line in FIG. 15. The movable cover 110 is normally pressed forward, that is, leftward in FIG. 15 by the spring 114 but locked by elongated holes 115 provided in the upper portion of the cover 110 and by protrusions 116 provided on the upper portion of the housing 107 and inserted in the elongated holes 115 respectively. An engagement groove 117 is provided in a top portion of the housing 107 so that the engagement protrusion 106*a* of the engagement piece 106 engages with the engagement groove 117 in a state of perfect connection. The engagement groove 117 is located in such a position that it is normally covered with the movable cover 110 but it is revealed when the movable cover 110 is moved backward.

When the aforementioned connectors 100 and 101 are fitted to each other, the pin contacts 102 and the socket contacts 103 touch each other as shown in FIG. 16 so that the engagement protrusion 106*a* engages with the engagement groove 117. In the perfect fitting state, the contracted springs 114 are restored and the engagement piece 106 is covered with the movable cover 110 so that there is no room for disengaging the engagement protrusion 106*a* from the engagement groove 117. Accordingly, the connection state is kept securely.

On the other hand, in an half fitting state, that is, in an improper fitting state, the engagement protrusion 106*a* runs onto the ceiling of the housing 107 so that the engagement piece 106 is bent upward. Accordingly, the front end of the engagement piece 106 strikes the opening edge of the movable cover 110 and the springs 114 are contracted. Accordingly, the movable cover 110 presses the engagement piece 116 on the basis of the repulsion force of the springs 114, so that the two connectors 100 and 101 are departed from each other so as not to be fitted to each other at all.

Although the aforementioned connectors can be prevented from being half-fitted to each other, the movable cover 110 is not moved so that the connectors cannot be fitted to each other if the opposite sides of the movable cover 110 are gripped to perform the fitting. Further, the engagement piece 106 is located on the housing 107 so as not to be covered with the housing 107 at the time of perfect fitting. Accordingly, there arises a problem that, when external force is applied to the movable cover 110, the engagement piece 106 may move easily so that the connectors are disconnected unexpectedry even they are in a fitting state.

To release the connectors from the fitting state, the two connectors must be disconnected from each other while the movable cover 110 is pulled in the connector fitting direction and the revealed engagement piece 106 is bent upward by a tool, or the like. This operation is difficult to be carried out by one operating person. There arises a problem in workability.

SUMMARY OF THE INVENTION

Taking such problems into consideration, an object of the present invention is to provide an half-fitting prevention connector set in which not only the operation of fitting the connectors to each other and disconnecting the connectors from each other is carried out easily but also the connectors are not easily disconnected from each other by external force so that a slidable body such as a movable cover, or the like, is not moved by external force even at the time of shipping.

In order to achieve the above object, according to a first aspect of the present invention, provided is an half-fitting prevention connector set comprising a pair of female and male connectors which are to be fitted and connected to each other so that repulsion force of an elastic member disposed in a housing of one of the female and male connectors prevents the female and male connectors from half-fitting to each other, wherein the half-fitting prevention connector set further comprises a lock member disposed in the housing so as to be slidable in a direction of mutual fitting of the female and male connectors for locking the other one of the female and male connector in the housing on the basis of function of the elastic member, and a support mechanism for supporting the lock member so that the lock member is slidable in the housing.

Preferably, the housing has a receiving space provided in the vicinity of a terminal receiving chamber for insertion of connection terminals therein so as to be slidable in the direction of fitting of the connectors for holding the lock member and the elastic member to stop the other one of the female and male connectors, and an opening portion provided as a part of the receiving space for exposing a part of the lock member to the outside.

Preferably, the lock member has a release protrusion for moving the lock member in the direction of mutual fitting of the female and male connectors when the fitting of the connectors is to be released.

Preferably, a housing of the other connector has a flexible lock arm, a housing lock provided on an upper portion of the lock arm so as to be stopped by the lock arm, and an half-fitting prevention lock provided in a side portion of the lock arm whereas the housing of the one connector has an half-fitting prevention lock stopper in the frontal end portion of the receiving space.

Preferably, the bending of the lock arm at the time of fitting of the connectors is suppressed by the half-fitting prevention lock stopper.

Preferably, a tongue-like operation prevention lock which is flexible and turned backward is provided under a lower surface of the lock member; an end of the operation prevention lock is stopped by a frontal end surface of a shelf portion provided in the housing of the one connector; and an upper surface of the shelf portion is provided so as to be in the same level as the upper surface of the housing of the other connector to be fitted into the housing.

Preferably, the lock member includes a lower slider supported in the housing of the one connector so as to be slidable and having the elastic member held in the inside of a rear wall and half-fitting prevention stoppers turned inward in a frontal end portion of opposite side walls, and an upper slider supported by an upper surface of the lower slider so as to be slidable while limited by a slide limiting mechanism, the upper slider having a rear end portion urged forward by the elastic member and having a flexible lock protrusion stopper provided on its front lower end for stopping a lock protrusion on a flexible lock arm provided on the other connector; and half-fitting prevention protrusions are provided on opposite sides of the lock arm of the partner connector.

Preferably, the lock member includes a lower slider supported in the housing of the one connector so as to be slidable and having the elastic member held in the inside of a rear wall and half-fitting prevention stoppers turned inward in a frontal end portion of opposite side walls, and an upper slider supported by an upper surface of the lower slider so as to be slidable while limited by a slide limiting mechanism and having a rear end portion urged forward by the elastic member and having a lock stopper provided on its front lower end for locking an half-fitting prevention protrusion on a flexible lock arm provided on the other connector.

According to the half-fitting prevention connector set configured as described above, when the housing lock presses the lock member in the connector fitting direction against the repulsion force of the elastic member at the time of fitting of the connectors, the repulsion force of the elastic member exceeds the insertion force of the connectors at the point of time when the half-fitting prevention lock runs over the half-fitting prevention lock stopper, so that the lock arm is bent. When the lock member is restored to its original position by using the repulsion force of the elastic member, the connectors are fitted perfectly.

Accordingly, when the hold is released before the half-fitting prevention lock of the lock arm runs over the half-fitting prevention lock stopper, the female and male connectors are disconnected from each other by the repulsion force of the elastic member, so that improper fitting is prevented. Further, when the operation of fitting the connectors to each other is to be carried out, it can be carried out while the side walls of the female housing are gripped because the lock member is covered with the female housing. Accordingly, the workability is improved.

Further, the bending of the lock arm in the half-fitting state is prevented securely by the half-fitting prevention lock and the half-fitting prevention lock stopper, so that the lock arm can be bent only at the time of the perfect-fitting to thereby prevent the half-fitting securely. Accordingly, the reliability is more improved.

Further, in the perfect-fitting state, the lock member is never moved by unexpected influence of external force because the lock member locks the housing lock and is covered with the female housing. Accordingly, reliability is improved.

Further, when the fitting state of the connectors is to be released, the male housing can be departed easily if the release protrusion is hooked by a finger so that the lock member is moved in the spring compressing direction while the lock arm is pressed. Accordingly, release can be made easily by one operating person, so that the workability is improved.

Further, when the operation prevention lock is provided in the lock member, the lock member is never pressed into the housing by unexpected external force at the time of shipping or at the time of safekeeping with respect to the single female connector. Accordingly, both the breaking of the elastic member and the entering of dust are prevented so that there is no barrier to current conduction. Accordingly, reliability is improved more greatly.

Further, in the half-fitting prevention connector set provided with the above-mentioned upper and lower sliders, the female and male connectors can be released from the perfect-fitting state if the connectors are separated from each other while the lock release protrusion is pressed down. Accordingly, the releasing operation can be carried out more easily by one operating person, so that the workability can be improved more greatly.

Further, because the upper and lower sliders are received as sliding bodies in the housing of the one connector in the perfect-fitting state, the sliders are never moved by unexpected external force. The fitting is not released unless the female and male connectors are separated from each other while the lock release protrusion of the other connector is pressed down artificially. Accordingly, both the safety and reliability can be improved.

Further, in the half-fitting prevention connector set in which there is no lock protrusion provided on the lock arm, the height of the lock protrusion can be shortened because there is no lock protrusion provided on the lock arm. Further, because the lock member of the other connector becomes only the half-fitting prevention protrusion, the dimensional accuracy of the height for avoiding the half-fitting prevention stopper of the other connector can be reduced. That is, the release of the fitting state of the female and male connectors due to low dimensional accuracy never occurs, so that not only the size of the connector set can be reduced but also the reliability of the connector set can be improved.

DETAILED DESCRIPTION OF THE PREFERRED EMBODIMENTS

Figure 1:
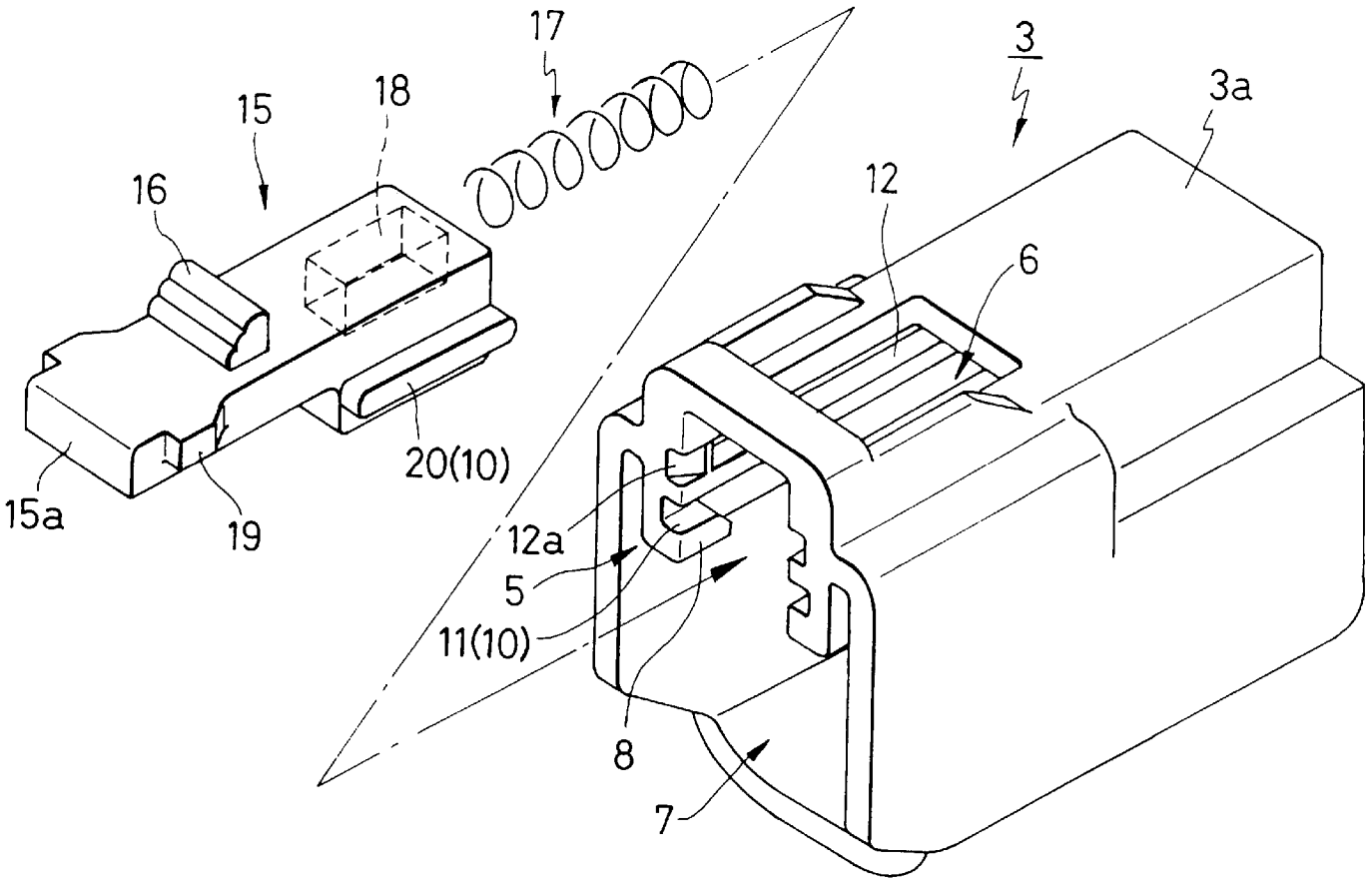
FIG. 1 is an exploded perspective view of a female connector and a slide lock member in an half-fitting prevention connector set according to a first embodiment of the present invention.
Figure 2:
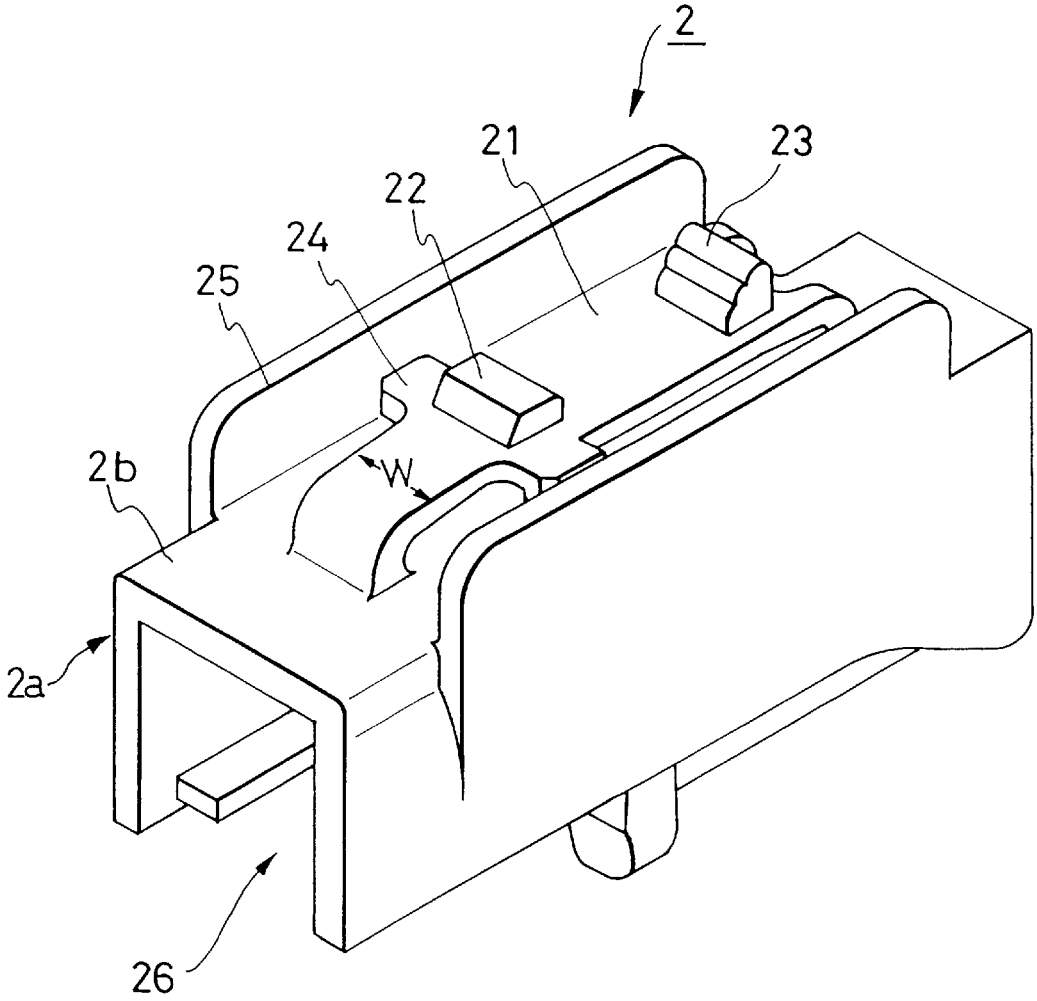
FIG. 2 is a perspective view of a male connector in the half-fitting prevention connector set according to the first embodiment of the present invention.
Figure 3:
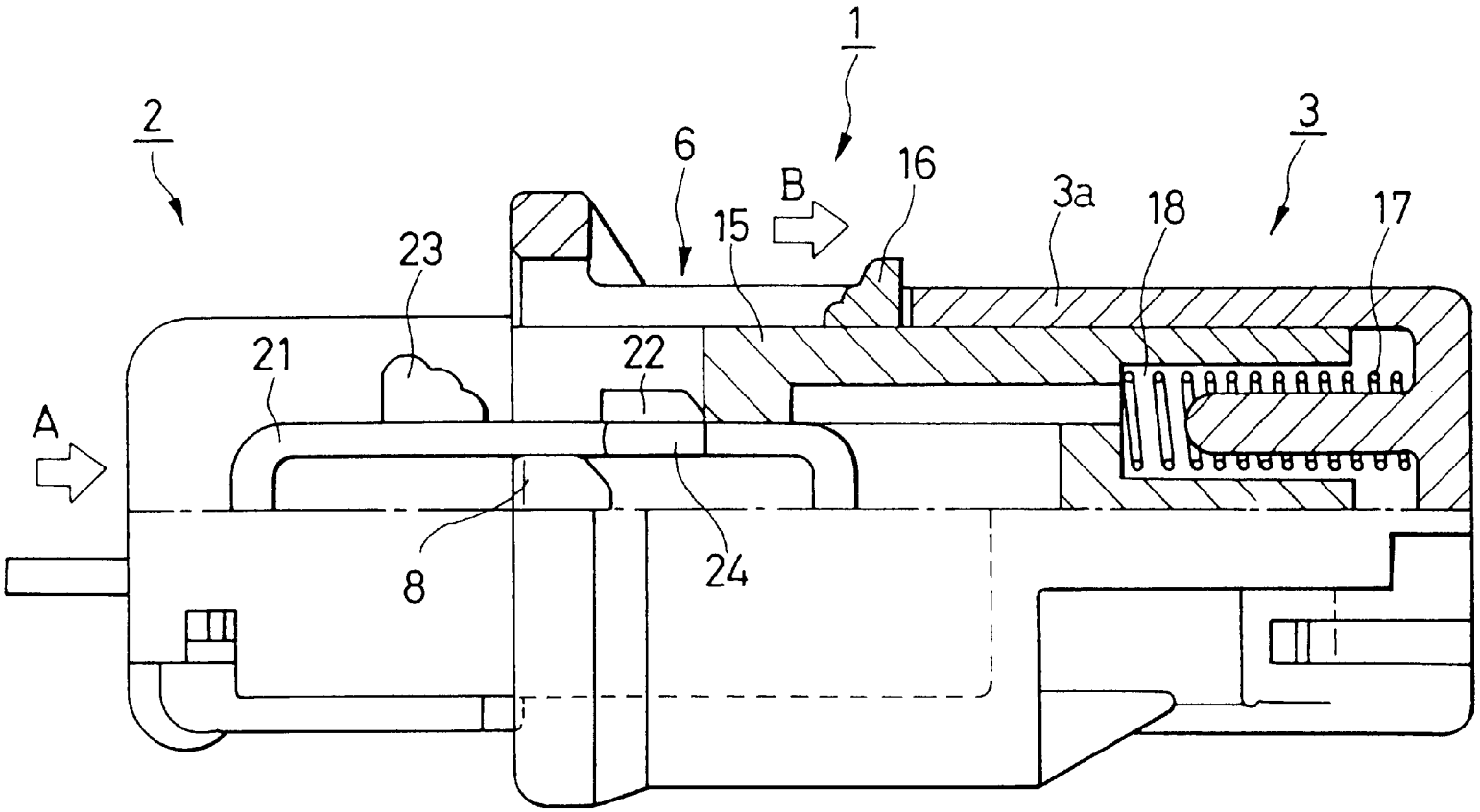
FIG. 3 is an operational explanatory view showing a state in which the male and female connectors in FIGS. 1 and 2 are on the way of fitting to each other.
Figure 4:
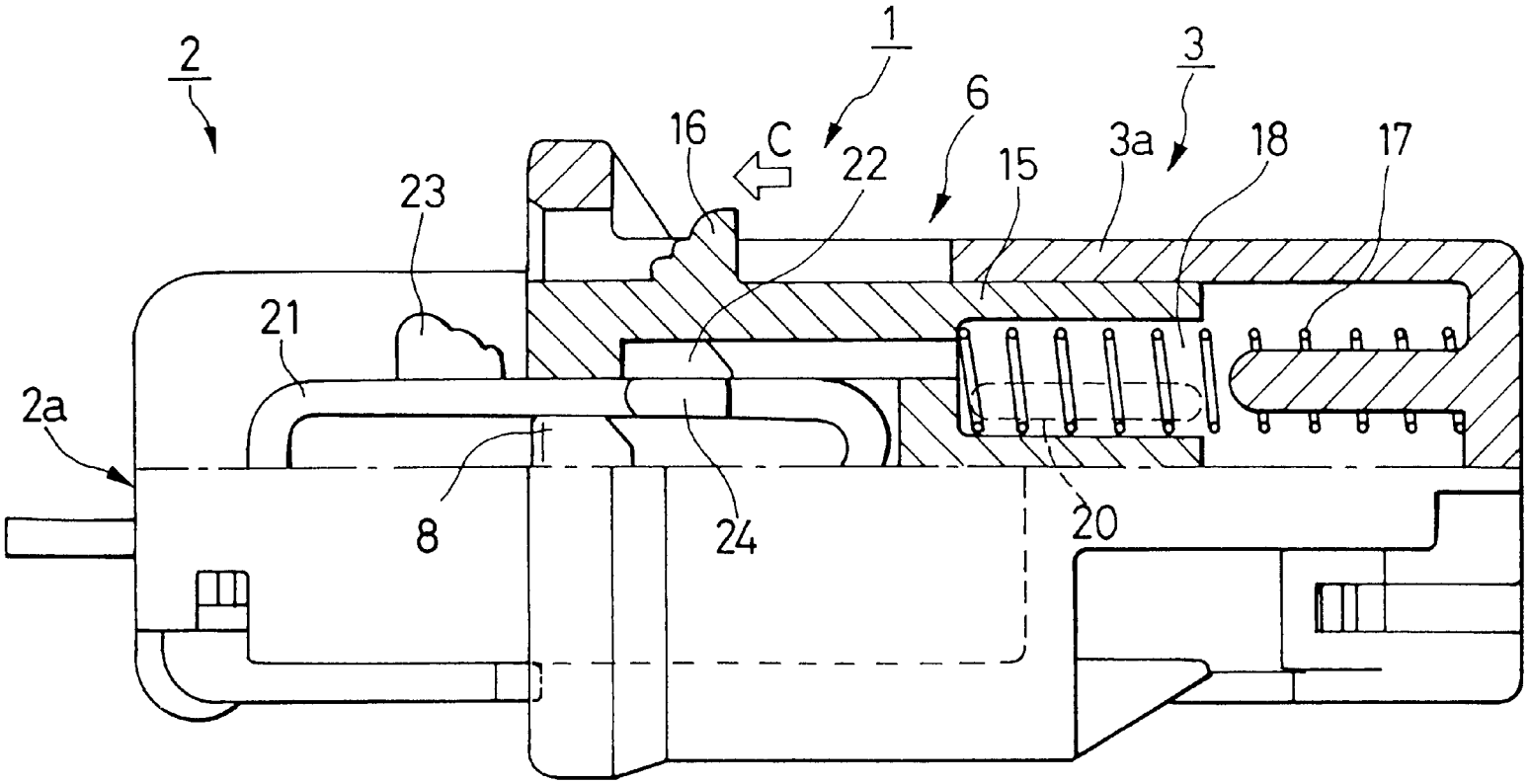
FIG. 4 is an operational explanatory view showing a state in which the fitting of the male and female connectors in FIG. 3 is completed.
Figure 5:
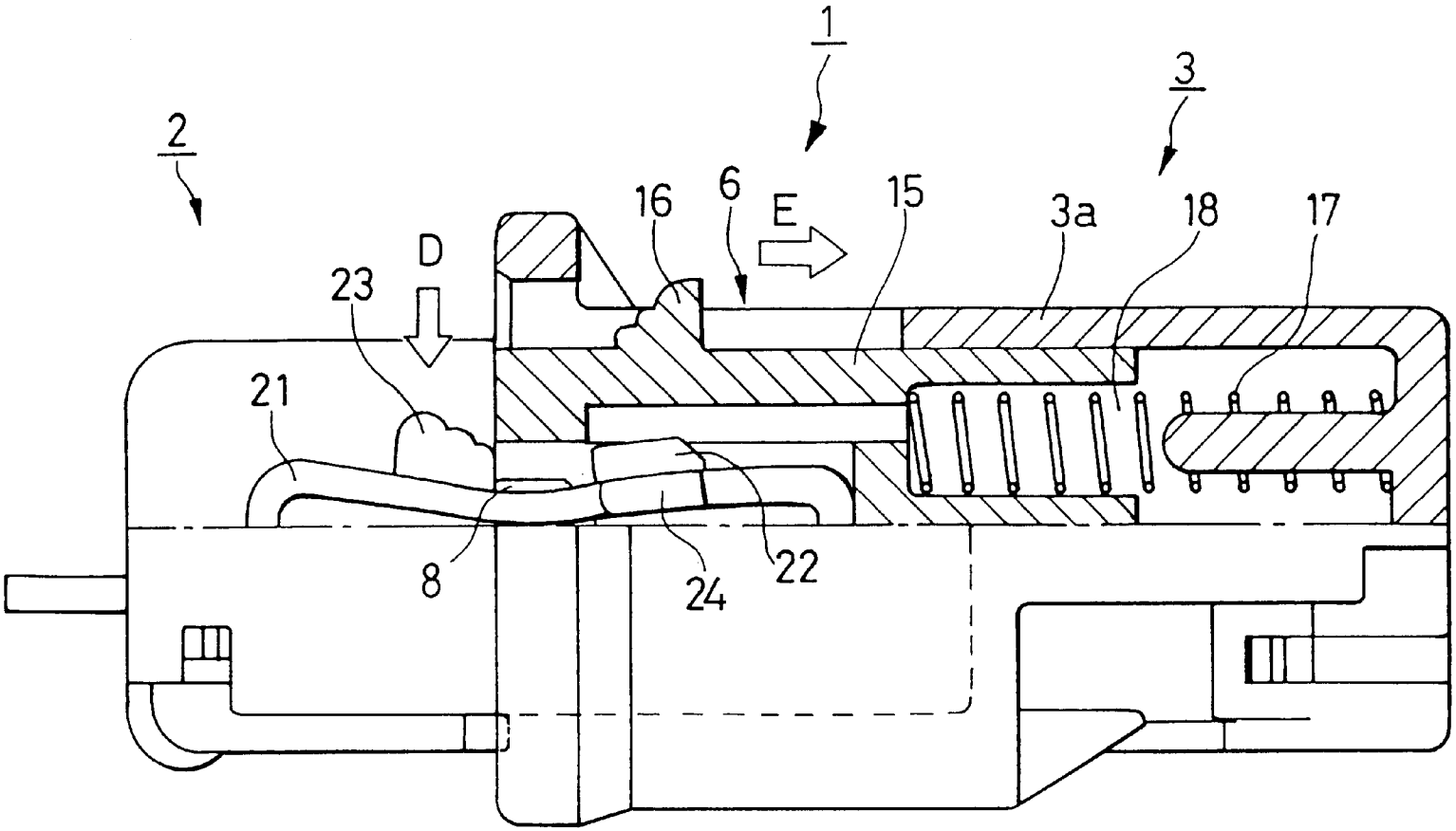
FIG. 5 is an operational explanatory view showing a state in which the fitting of the male and female connectors in FIG. 4 is released.
Figure 6:
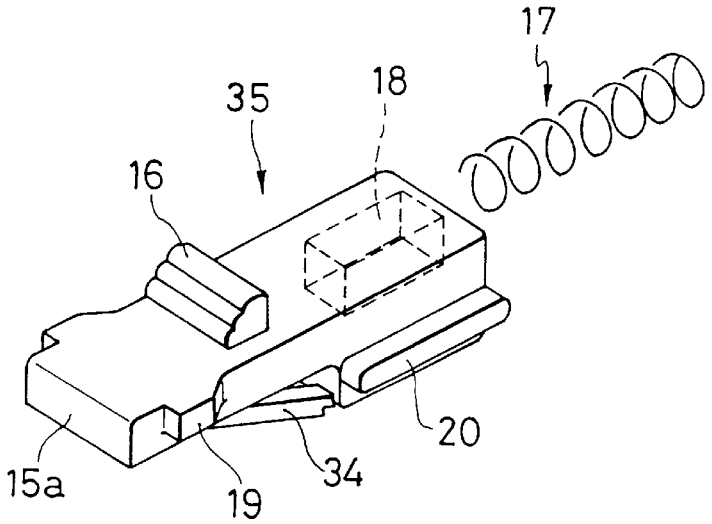
FIG. 6 is an exploded perspective view of a slide lock member having an operation prevention lock according to a second embodiment of the present invention.
Figure 7:
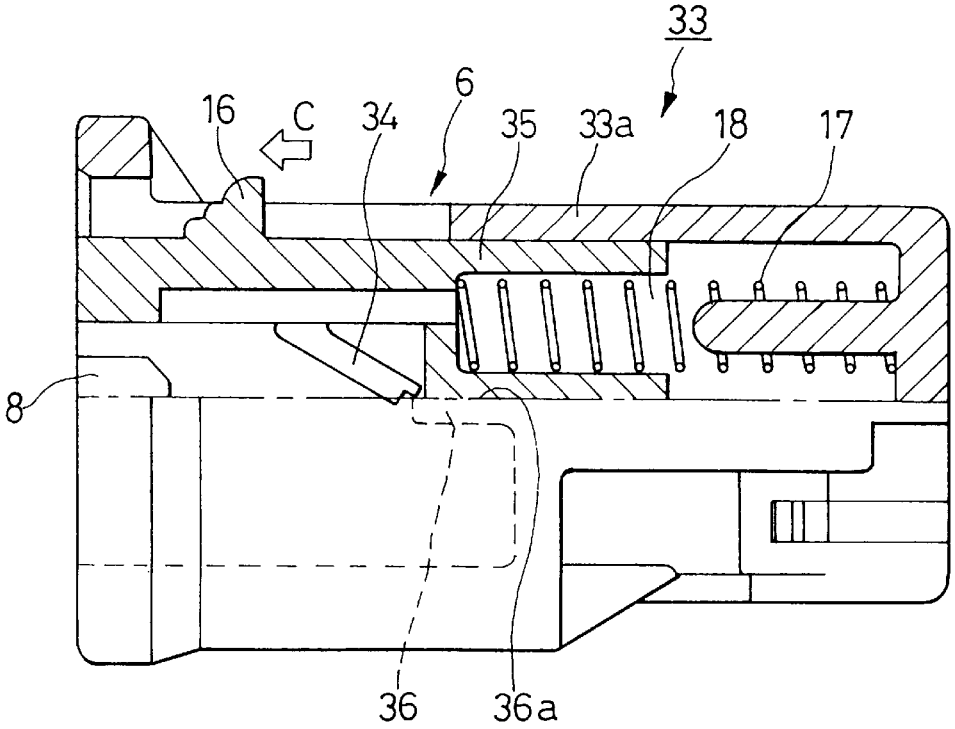
FIG. 7 is a vertical sectional view of a female connector using the slide lock member in FIG. 6.
Figure 8:
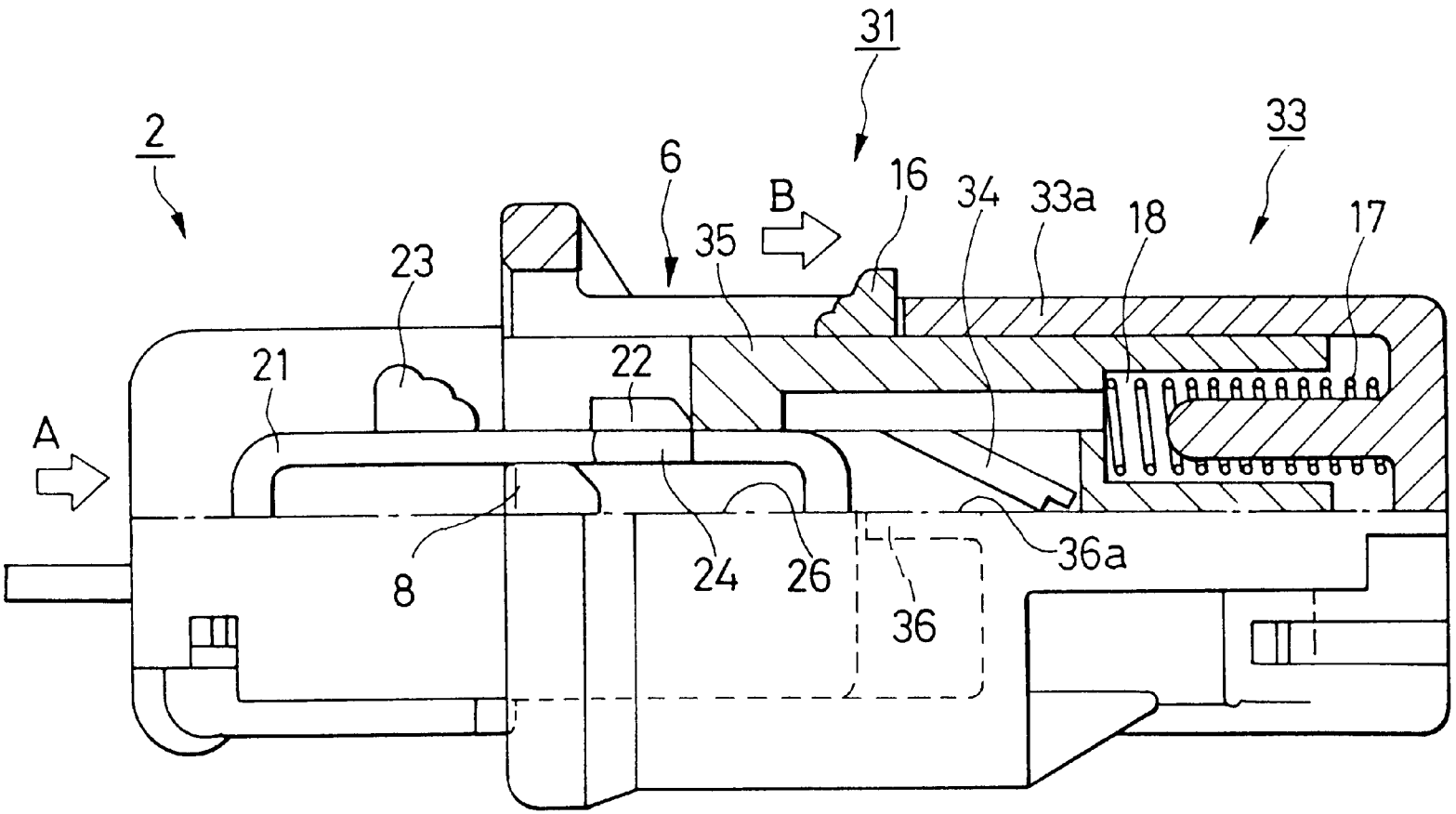
FIG. 8 is an operational explanatory view showing the fitting function of the female and male connectors using the slide lock member of FIG. 6 in the state where the connectors are on the way of fitting to each other.
Figure 9:
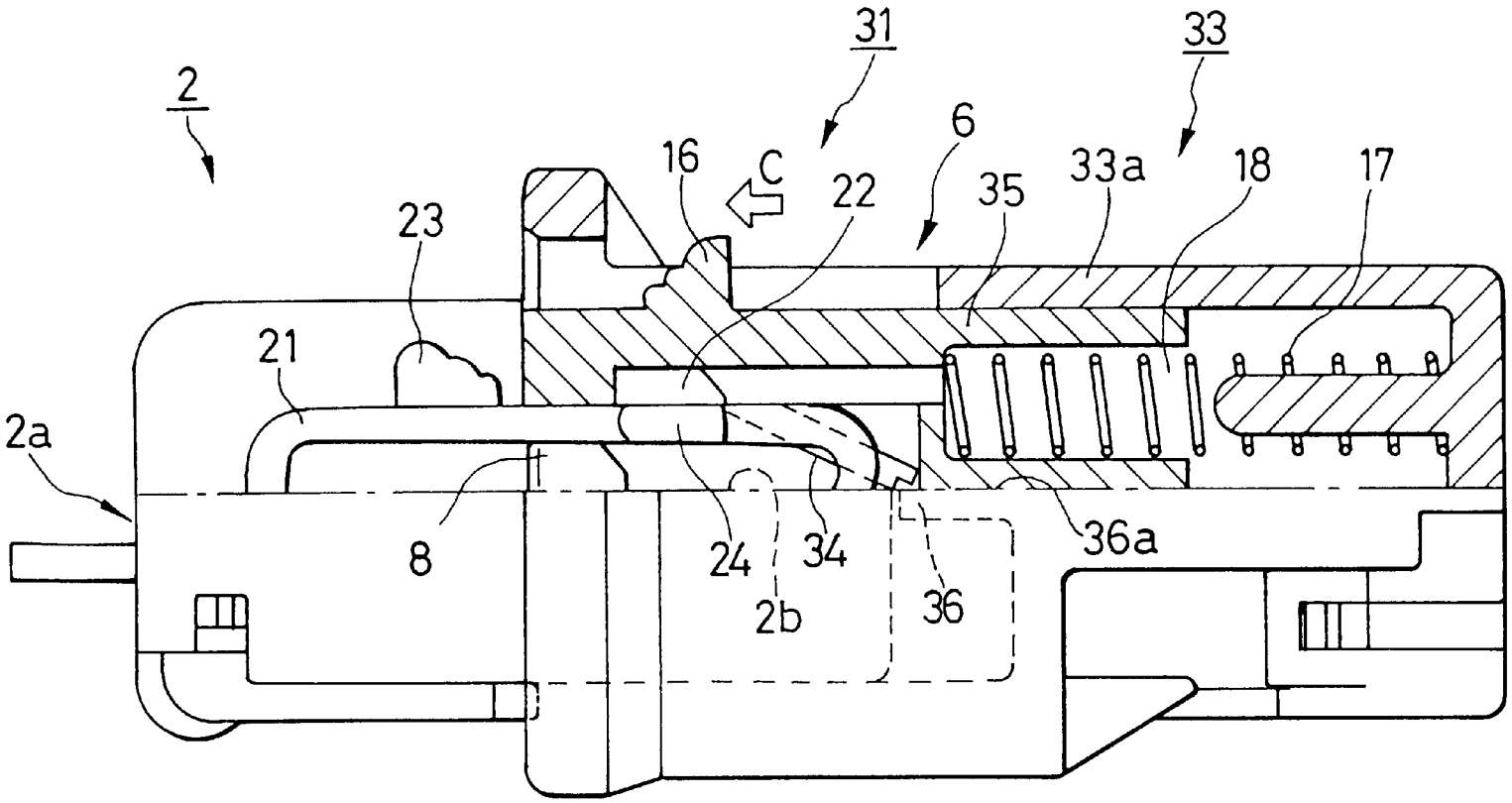
FIG. 9 is an operational explanatory view showing a state in which the fitting of the connectors in FIG. 8 is completed.
Figure 10:
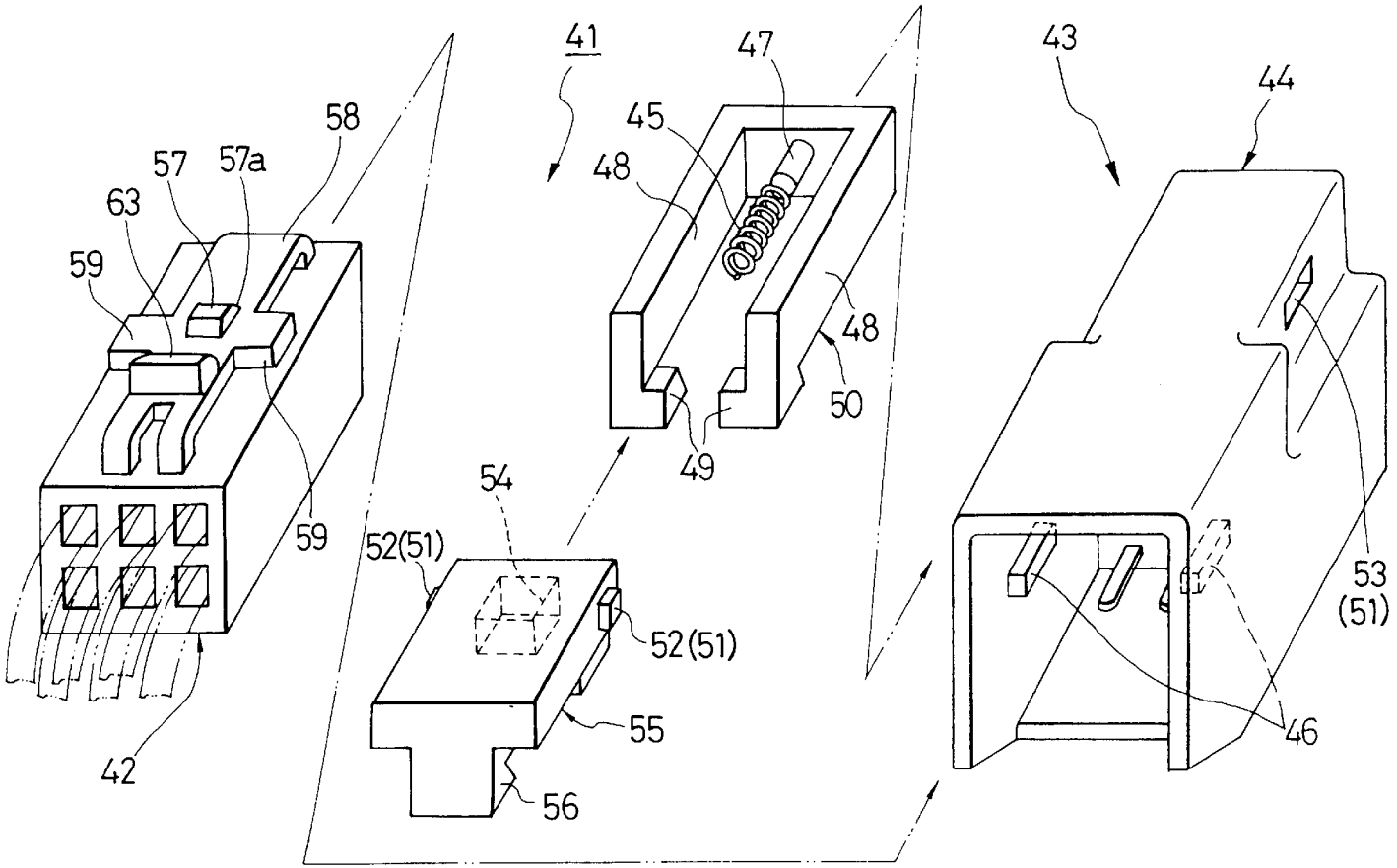
FIG. 10 is an exploded perspective view of an half-fitting prevention connector set according to a third embodiment of the present invention.
Figure 11:
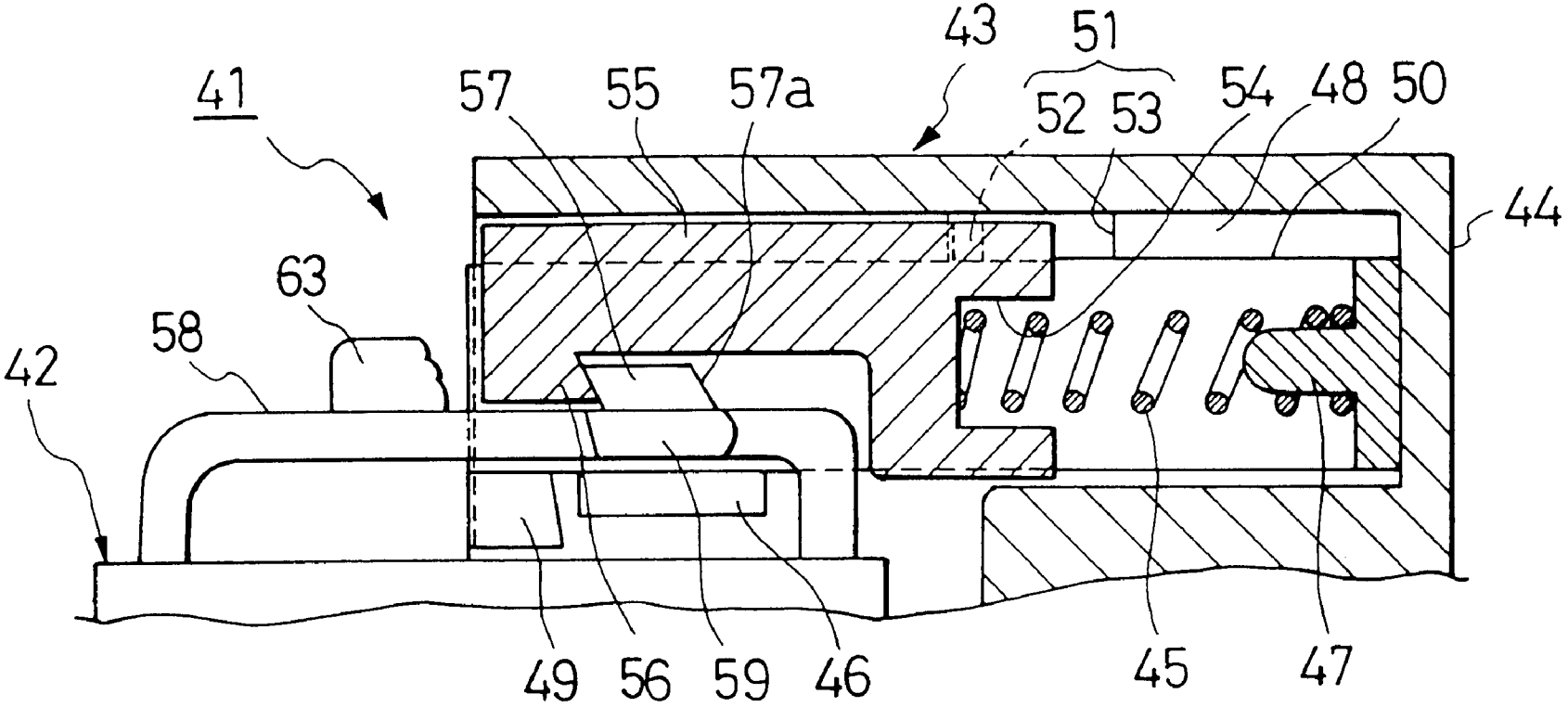
FIG. 11 is a vertical sectional view at the time of perfect fitting in FIG. 10.
Figure 13:
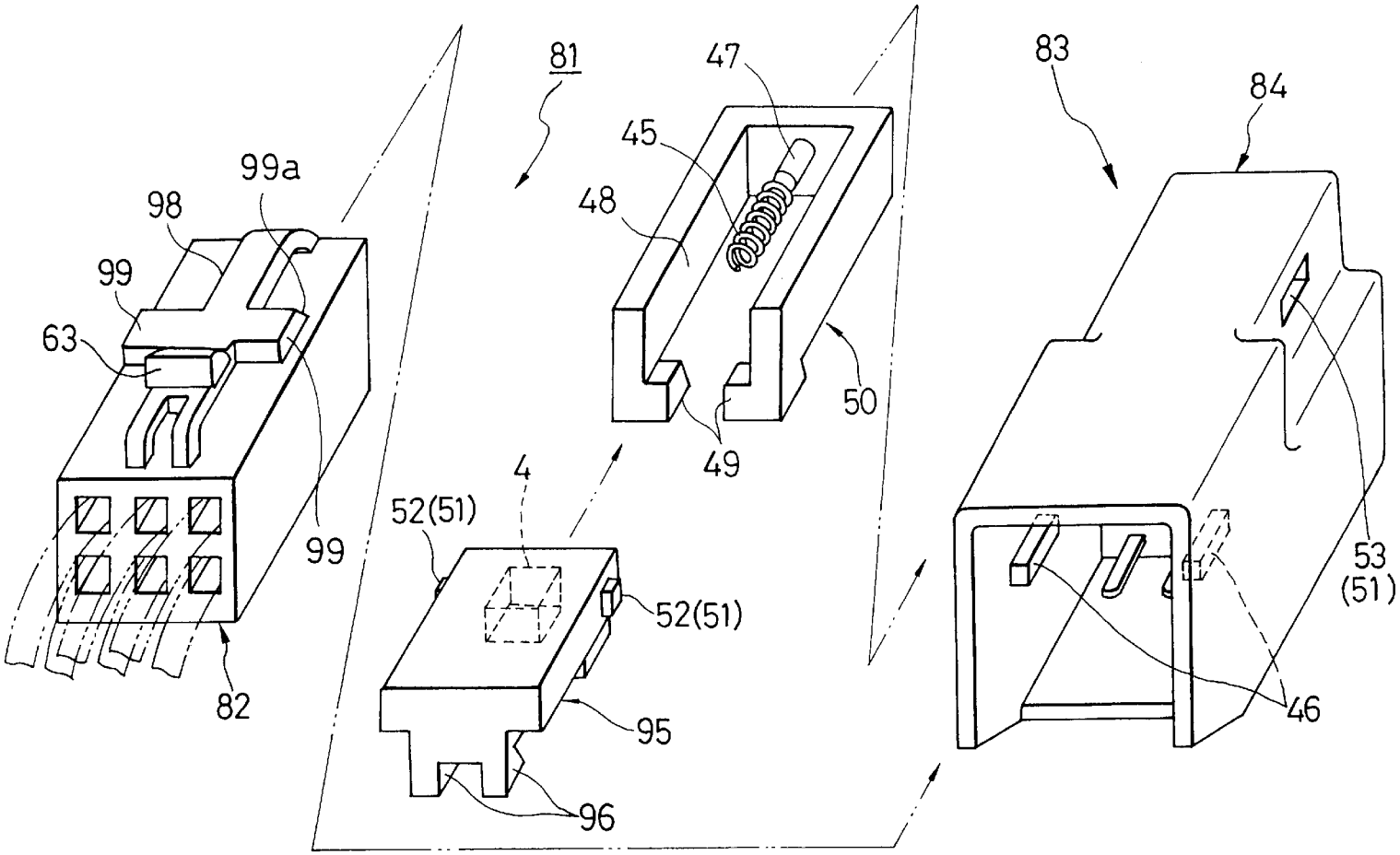
FIG. 13 is an exploded perspective view of a half-fitting prevention connector set according to a fourth embodiment of the present invention.
Figure 14:
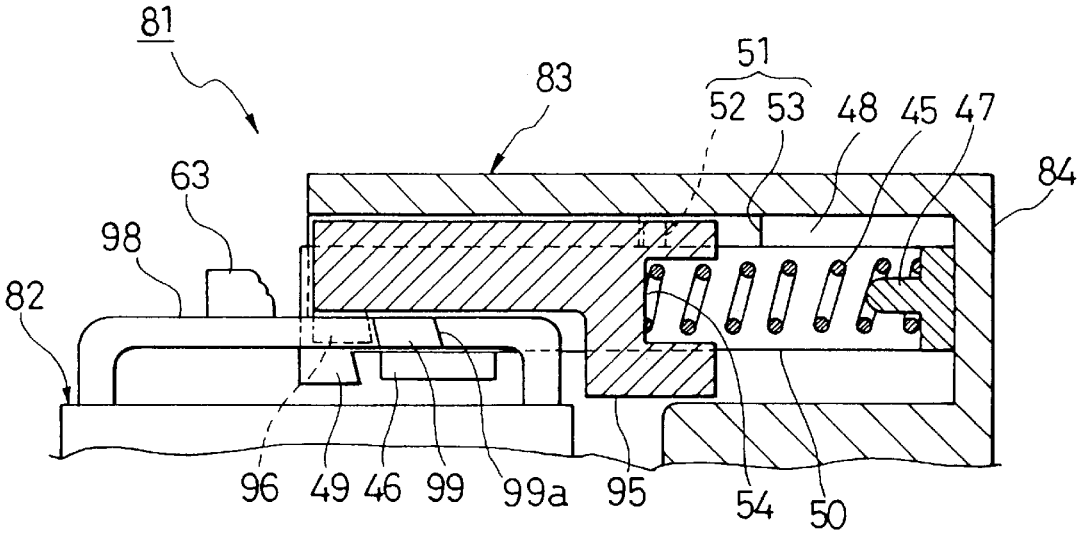
FIG. 14 is a vertical sectional view at the time of perfect fitting in FIG. 13.
Figure 15:
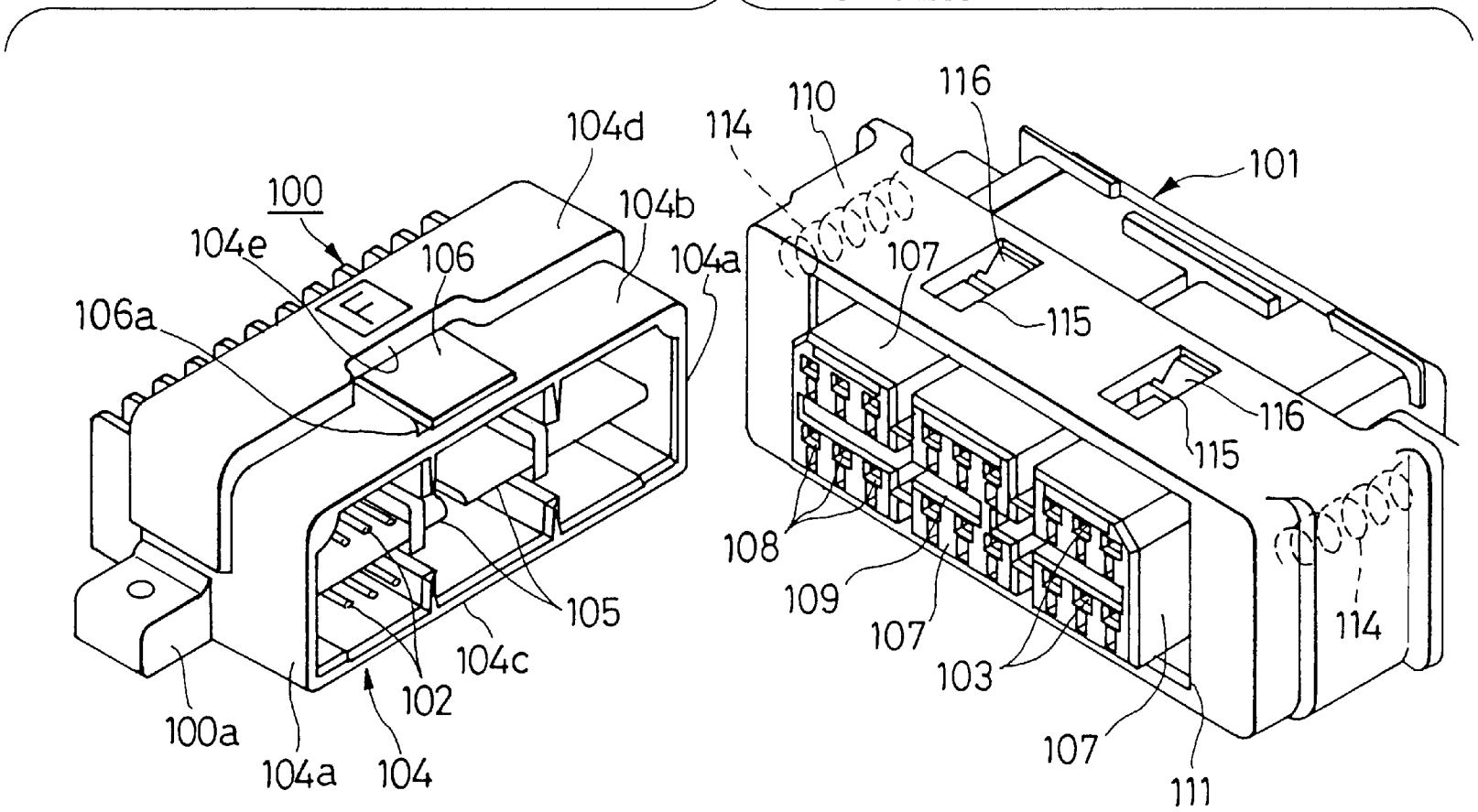
FIG. 15 PRIOR ART
FIG. 15 is a perspective view showing an example of configuration of a conventional connector set.
Figure 16:
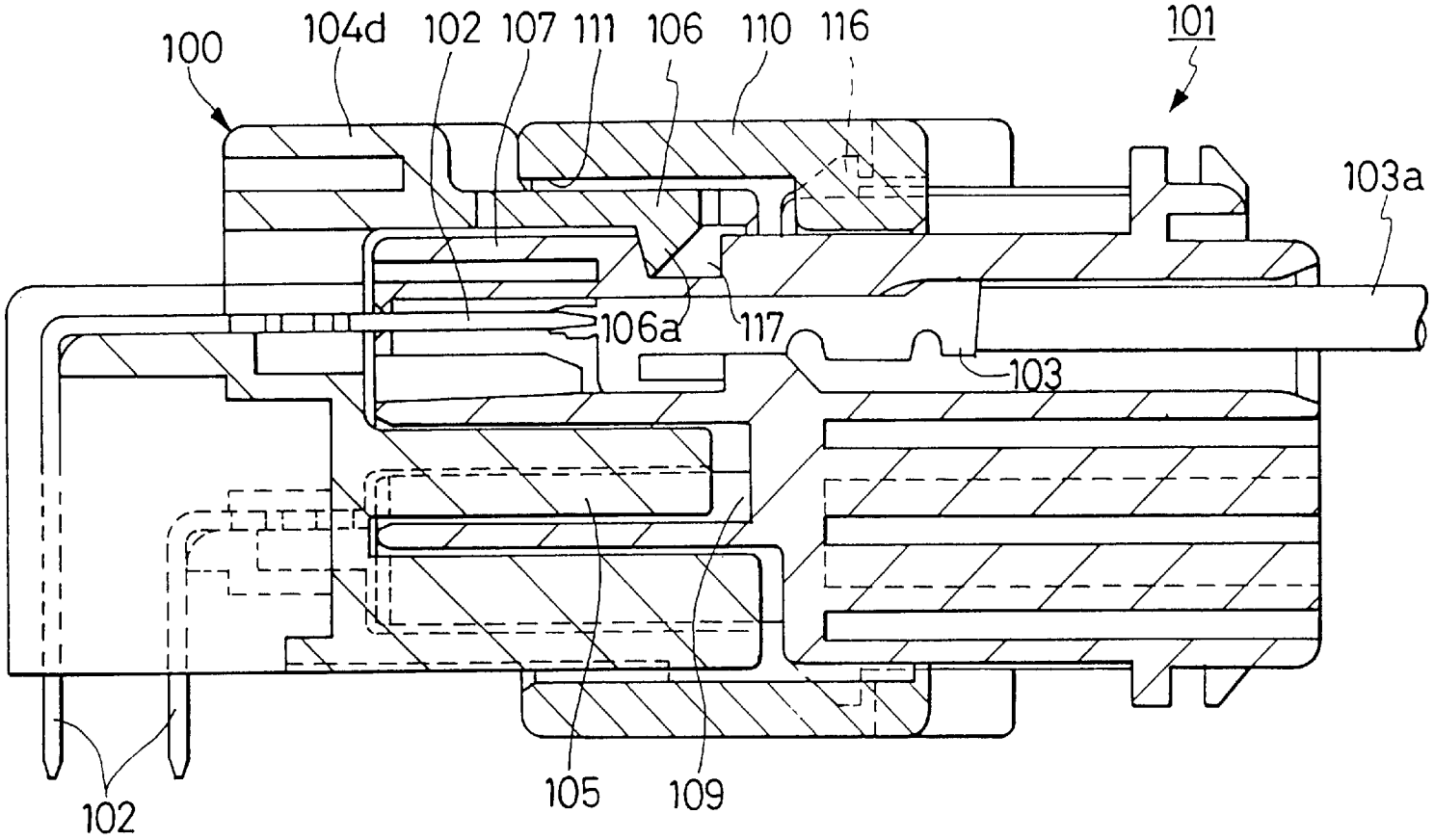
FIG. 16 PRIOR ART
FIG. 16 is a vertical sectional view showing a state in which connectors in FIG. 15 are fitted to each other.

Embodiments of the present invention as to an half-fitting prevention connector set will be described below in detail with reference to FIGS. 1 through 9. FIG. 1 is an exploded perspective view of a female connector and a lock member in the half-fitting prevention connector set according to a first embodiment of the invention, FIG. 2 is a perspective view of a male connector in the half-fitting prevention connector set according to the first embodiment of the invention, FIG. 3 is an operational explanatory view showing a state in which the male and female connectors in FIGS. 1 and 2 are on the way of fitting to each other, FIG. 4 is an operational explanatory view showing a state in which the fitting of the male and female connectors in FIG. 3 is completed, FIG. 5 is an operational explanatory view showing a state in which the fitting of the male and female connectors in FIG. 4 is released, FIG. 6 is an exploded perspective view of a slide lock member having an operation prevention lock according to a second embodiment of the invention, FIG. 7 is a vertical sectional view of a female connector using the slide lock member in FIG. 6, FIG. 8 is an operational explanatory view showing a state in which the female and male connectors using the slide lock member in FIG. 6 are on the way of fitting to each other, FIG. 9 is an operational explanatory view showing a state in which the fitting of the connectors in FIG. 8 is completed, FIG. 10 is an exploded perspective view of an half-fitting prevention connector set according to a third embodiment of the invention, FIG. 11 is a vertical sectional view at the time of perfect fitting in FIG. 10, FIG. 12 is an operational explanatory view at the time of disconnection in FIG. 10, FIG. 13 is an exploded perspective view of an half-fitting prevention connector set according to a fourth embodiment of the invention, and FIG. 14 is a vertical sectional view at the time of perfect fitting shown in FIG. 13.

In the female half-fitting prevention connector 1 shown in FIG. 1, a terminal receiving chamber 7 for receiving and holding a connection terminal is provided at a lower portion of an internal space of a housing 3, and a receiving space 5 for receiving and holding the slide lock member 15 is provided at an upper portion of the internal space of the housing 3. A pair of guide grooves 11 and 12, serving as an support mechanism, are formed in each of opposed side surfaces of the receiving space 5. A slide lock retaining portion 12*a* for preventing withdrawal of the slide lock member 15 is provided at a front end portion of the upper guide groove 12 in a direction of mutual fitting of the female and male connectors, this retaining portion 12*a* having an inclined surface for facilitating the insertion of the slide lock member 15 in a fitting direction. A half-fitting prevention lock stopper 8 is provided at a front end portion of the lower guide groove 11. An opening 6 is formed through an upper wall of the housing 3, and this opening 6 forms an upper portion of the receiving space 5.

The slide lock member 15 has a release projection 16 formed on an upper surface thereof, and a pair of slide stoppers 19 which are formed respectively on opposite sides of the slide lock member 15, and are disposed near to the release projection 16. The slide stoppers 19 are received respectively into the upper guide grooves 12 in the housing 3. A spring receiving chamber 18 for receiving a compression spring (resilient member) 17 is formed in a rear end portion of the slide lock member 15, and a pair of support projections 20 for being received respectively in the lower guide grooves 11 are formed respectively on the opposite sides of the slide lock member 15, and are disposed near to the spring receiving chamber 18.

A terminal receiving chamber 26 for receiving and holding a connection terminal is formed in a male housing 4 of the male connector 2. An elastic lock arm 21 is formed on an upper surface of the housing 4, and a pair of upstanding guide side walls 25 are formed respectively on opposite side walls of the housing 4.

A housing lock 22 for retaining engagement with the slide lock member 15 is formed on an upper surface of the lock arm 21, and a pair of half-fitting prevention locks 24 are formed respectively on opposite side edges of the lock arm 21, and are disposed near to the housing lock 22. A lock release projection 23 is formed on the upper surface of the lock arm 21 at a rear end portion thereof, and this lock release projection 23 is pressed or depressed when releasing the fitting.

In the above half-fitting prevention connector of this embodiment, first, the compression spring 17 is inserted into the spring receiving chamber 18 in the slide lock member 15, and in this condition the slide lock member 15 is inserted into the housing 3 as shown in FIG. 1, with the slide stoppers 19 received respectively in the upper guide grooves 12 and also with the support projections 20 received respectively in the lower guide grooves 11.

Then, the female connector 1 and the male connector 2 are fitted together as shown in FIG. 3. More specifically, when the male connector 2 is pushed into the female connector 1 in a direction of arrow A, a front end of the housing lock 22 on the lock arm 21 is abutted against a press end surface 15*a* of the slide lock member 15 to move the slide lock member 15 in a direction of arrow B against repellent force of the compression spring 17, and the half fitting prevention locks 24 are disposed respectively above the half-fitting prevention lock stoppers 8.

In this condition, even if the lock arm 21 intends to be flexed downward, it can not be flexed since the half-fitting prevention locks 24 are abutted respectively against the upper surfaces of the half-fitting prevention lock stoppers 8.

In this condition, when the male connector 2 is further inserted against the bias of the compression spring 17, the half-fitting prevention locks 24 pass respectively past the half-fitting prevention lock stoppers 8, and are fitted respectively in the lower guide grooves 11, and also under the influence (resiliency) of the compression spring 17, the press end surface 15*a* of the slide lock member 15 slides past a slanting surface of the housing lock 22 while flexing the lock arm 21 downwardly.

Therefore, the slide lock member 15 is returned in a direction of arrow C as shown in FIG. 4, so that the housing lock 22 is retainingly engaged with the lower side of the slide lock member 15, thus completely the fitting between the female connector 1 and the male connector 2.

For releasing the fitting between the female connector 1 and the male connector 2, the lock release projection 23 on the lock arm 21 is pressed in a direction of arrow D (FIG. 5) to be flexed downward, thereby releasing the retained condition of the housing lock 22. Then, in this pressed condition, the slide lock member 15 is pulled in a direction of arrow E, so that the press end surface 15*a* of the slide lock member 15 slides past the housing lock 22 of the male connector 2, and the lock arm 21 is restored into its original configuration because of its elasticity, and the male connector 2 can be easily disengaged from the female connector 1 by pressing repellant force of the compression spring 15.

The second embodiment of the present invention shown in FIGS. 6 through 9 will be described below. The second embodiment is different from the first embodiment in that a tongue-like operation prevention lock 34 flexible and having an end looking backward is provided under the lower surface of a slide lock member 35 so that the end of the operation prevention lock 34 is locked by the front end surface of a shelf portion 36 provided in a housing 33*a* of a female connector 33 and the upper surface 36*a* of the shelf portion 36 is provided so as to be in the same level as the upper surface 2*b* of a housing 2*a* of a male connector 2 fitted into the housing 33*a* of the female connector 33. Accordingly, the same reference numerals as in FIGS. 1 through 5 are given to the same parts having the same functions in FIGS. 6 through 9 and the detailed description of configuration and operation about these parts will be omitted.

As will be obvious from the description of the operation which will be made later, a pair of operation prevention locks 34 are provided so that a lock arm 21 of the male connector 2 is disposed between the pair of operation prevention locks 34, taking interference with the lock arm 21 into consideration. The arm width W of the lock arm 21 shown in FIG. 2 is required to be set to be smaller than the internal width of the operation prevention lock 34. A level difference as shown in FIG. 7 is preferably provided in the end of the operation prevention lock 34 so that the upper step portion of the end of the operation prevention lock 34 is caught in an end portion of the upper surface 36*a* of the shelf portion 36 when the slide lock member 35 is located in a predetermined position, that is, in the front most end position.

The operation of the half-fitting prevention connector set 31 having the operation prevention locks 34 is substantially the same as the operation of the half-fitting prevention connector set 1. Only the different point will be described and the detailed description of the operation will be omitted. First, when the male connector 2 as a partner connector is fitted into the housing 33*a* of the female connector 33, the end of the operation prevention lock 34 is put on the upper surface 2*b* of the male connector 2. When the slide lock member 35 is then pressed by the housing lock 22 to go back as shown in FIG. 8, the end of the operation prevention lock 34 slides on the upper surface 36*a* of the shelf portion 36 which forms the same plane as the upper surface 2*b*. Similarly to the case of the half-fitting prevention connector set 1, a perfect fitting state as shown in FIG. 9 is obtained finally.

Not only the half-fitting prevention connector set 31 has the same function as the half-fitting connector set 1 but also even in the case where the female connector 33 collides with an obstacle such as a tool, or the like, so that the front end of the slide lock member 35 is strongly hit backward by unexpected external force when the female connector 33 exists independently in an assembled state at the time of shipping, at the time of safekeeping, or the like, the slide lock member 35 is never moved back because the end of the operation prevention lock 34 abuts on the front wall of the shelf portion 36. Accordingly, the compression spring 17 is never abnormally compressed and broken.

If the front surface of the female connector 33 is further covered with a dust-proof sheet, the dust-proof sheet is never broken because the operation prevention lock 35 is never moved backward by unexpected external force. Accordingly, prevention of abnormal compression of the compression spring 17 and greater improvement of reliability combined thereto can be attained.

As shown in FIGS. 10 through 12, the half-fitting prevention connector set 41 according to the third embodiment of the present invention is configured so that the half-fitting state of female and male connectors 43 and 42 is detected on the basis of the repulsion force of a compression spring 45 as an elastic member received in a housing 44 of one of the female and male connectors 43 and 42 to be fitted and connected to each other.

A lower slider 50 is inserted into the upper half of the housing 44 of one female connector 43 in a manner such that it is supported by a plurality of support protrusions 46 so as to be slidable back and forth, and in the lower slider 50, the compression spring 45 is supported by a guide pin 47 on the inner side of the rear wall and half-fitting prevention stoppers 49 extending inward are provided on the front end portions of the opposite side walls 48. Further, an upper slider 55 is supported by the upper surface of the lower slider 50 so as to slide back and forth while the sliding range is limited by a slide limiting mechanism 51 constituted by slide protrusions 52 and guide holes 53, the upper slider 55 has a spring receiving chamber 54 provided in the rear end portion so as to be urged forward by the compression spring 45, and a lock protrusion stopper 56 formed on the frontal lower end for locking the lock protrusion 57 of the other male connector 42.

A flexible lock arm 58 having front and rear ends supported by the upper surface of the other male connector 42 is provided. The lock arm 58 has a lock protrusion 57 in the center, half-fitting prevention protrusions 59 in the opposite sides, and a lock release protrusion 63 in the rear. The male connector 42 is inserted into the lower half of the housing 44 of the female connector 43.

Referring to FIGS. 10 through 12, the operation of the half-fitting prevention connector set 41 according to the third embodiment configured as described above will be described below. When the female and male connectors 43 and 42 are pressed while the respective front ends of the female and male connectors 43 and 42 are arranged face to face, the fitting of the connectors 43 and 42 is started. As shown in FIG. 11, first, after the lock protrusion 57 of the male connector 42 abuts on the front end surface of the lock protrusion stopper 56 of the upper slider 55 of the female connector 43, the upper slider 55 is pressed backward against the repulsion force of the compression spring 45. Then, the half-fitting prevention protrusion 59 passes through on the half-fitting prevention stopper 49 and the repulsion force of the compression spring 45 increases. When the holding is released in this stage so that the pressing force for fitting is canceled, the compression spring 45 presses the male connector 42 back together with the lock protrusion 57 through the lock protrusion stopper 56 of the upper slider 55. As a result, the male connector 42 is separated from the female connector 43, so that the half-fitting state can be detected.

On the contrary, when the pressing force for fitting is further increased, the lock protrusion 57 sinks under the lock protrusion stopper 56 while the lock arm 58 is bent downward by a front end inclined surface 57*a* of the lock protrusion 57 because the half-fitting prevention protrusion 59 has already passed through on the half-fitting prevention stopper 49. As a result, the upper slider 55 is pressed out forward by the repulsion force of the compression spring 45, so that the slide protrusion 52 abuts on the front end surface of the guide hole 53 and stops in the front most end position because the movement of the slide protrusion 52 is limited by the front end surface of the guide hole 53. The bending of the lock arm 58 is restored to its original position and the lock protrusion 57 is locked by the lock protrusion stopper 56, so that the female and male connectors 43 and 42 are fitted perfectly.

In the perfect fitting state, the upper slider 55 and the lower slider 50 are received as sliding bodies in the housing 44. Accordingly, the sliders 55 and 50 are never moved by unexpected external force, so that the fitting state of the female and male connectors 43 and 42 is never released. Even in the case where the lock release protrusion 63 is pressed down by unexpected external force so that the lock arm 58 is bent, the fitting state of the female and male connectors 43 and 42 is never released because the half-fitting prevention protrusion 59 is locked by the half-fitting prevention stopper 49 but also because the lower slider 50 is pressed backward with respect to the housing 44 by the compression spring 45. Accordingly, both the safety and reliability can be improved.

Figure 12A:
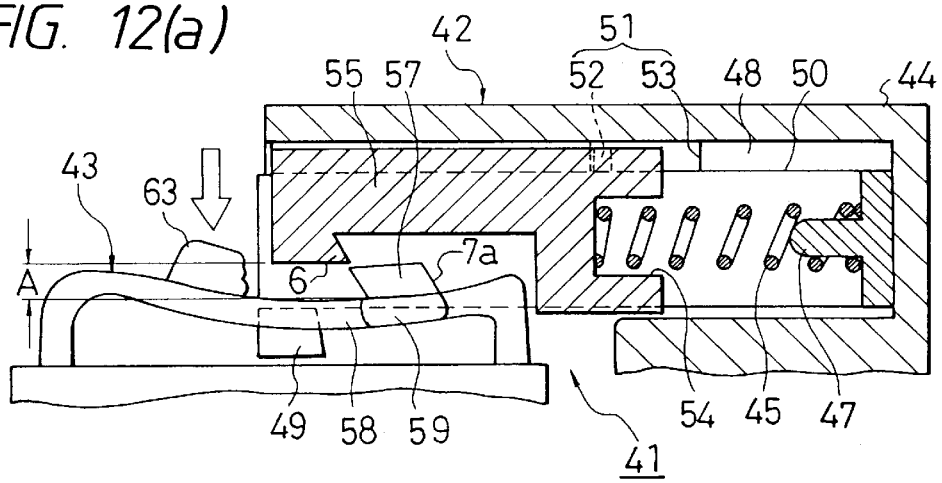
FIG. 12 is an operational explanatory view at the time of disconnection in FIG. 10.
Figure 12B:
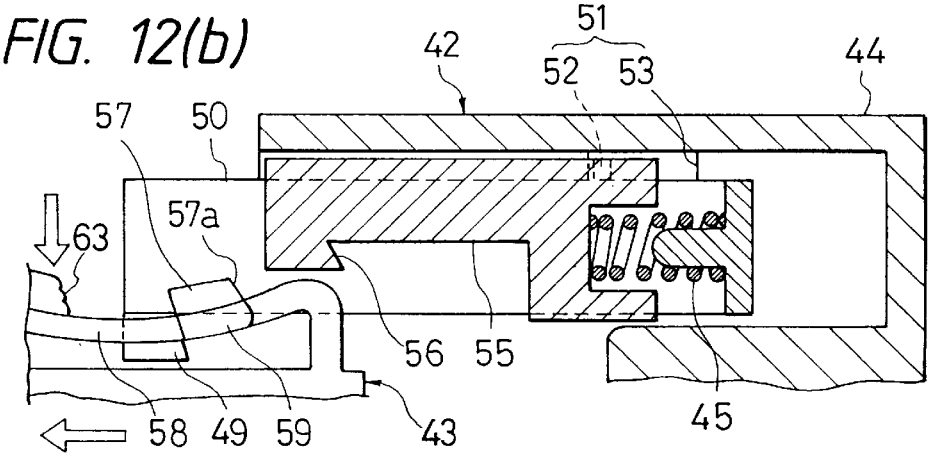

To cancel the fitting state of the female and male connectors 43 and 42, first, the lock release protrusion 63 is pressed down as shown in FIG. 12*a* so that the lock arm 58 is bent downward. As a result, the lock protrusion 57 is released from the lock protrusion stopper 56 and, at the same time, the half-fitting prevention protrusion 59 is locked by the half-fitting prevention stopper 49. When the female and male connectors 43 and 42 in this state are to be separated from each other as shown in FIG. 12*b*, only the lower slider 50 is drawn out to the half-fitting prevention protrusion 59 while the compression spring 45 is compressed because the upper slider 55 is limited by the slide limiting mechanism 51 so that the upper slider 55 cannot go ahead any more.

Figure 12C:
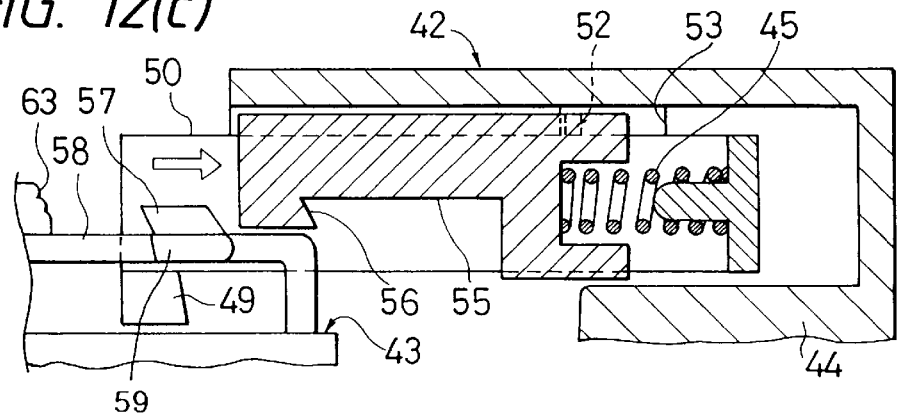

At the point of time when the repulsion force of the compression spring 45 increases, the half-fitting prevention protrusion 59 and the lock protrusion 57 are drawn out to the front of the lock protrusion stopper 56, that is, to the outside of the front end of the housing 44. Accordingly, if the pressing of the lock release protrusion 63 is canceled as shown in FIG. 12*c*, the bending of the lock arm 58 is canceled so that the lock arm 58 restores to its original position, or the half-fitting prevention stopper 49 is released from the lock of the half-fitting prevention protrusion 59 so that the lower slider 50 is restored to the rearmost end position by the repulsion force of the compression spring 45. Accordingly, the fitting state of the female and male connectors 43 and 42 can be released easily.

In order to release the female and male connectors 43 and 42 from the perfect fitting state, it will do to separate the lock release protrusion 63 of the male connector 42 from the female connector 43 while the protrusion 63 is pressed down and release the lock release protrusion 63 when the repulsion force of the compression spring 45 becomes large. Accordingly, the operation of disconnecting the connectors from each other can be carried out easily.

As described above, the half-fitting prevention connector set 41 is configured so that not only the half-fitting state of the female and male connectors 43 and 42 can be detected by the compression spring 45 urged in the reverse fitting direction but also the fitting of the connectors is performed by the compression spring 45 provided on the one female connector 43 side and the lock protrusion stopper 56 of the upper slider 55 and by the lock protrusion 57 and the flexible lock arm 58 provided on the other male connector 42 side. Accordingly, the fitting structure is so simple that not only the size of the connector set can be reduced easily but also the cost of the connector set can be reduced.

In order to release the perfect-fitting state of the female and male connectors 43 and 42, it will do to separate the female connector 43 while the lock release protrusion 63 is pressed down. Accordingly, the separating operation can be carried out easily so that the workability can be improved.

Further, because the upper slider 55 and the lower slider 50 are received, as sliding bodies, in the housing 44 of the female connector 43 in the perfect-fitting state, the upper and lower sliders 55 and 50 are never moved by unexpected external force so that the fitting state of the connectors is never released unless the female and male connectors 43 and 42 are separated from each other while the lock release protrusion 63 of the male connector 42 is pressed down artificially. Accordingly, both the safety and reliability can be improved.

Referring to FIGS. 13 and 14, the half-fitting prevention connector set according to the fourth embodiment of the present invention will be described below in detail. The half-fitting prevention connector set 81 according to the fourth embodiment is different from the half-fitting prevention connector set 41 according to the third embodiment in that the lock protrusion 57 (see FIG. 10) is removed onto a lock arm 98 of a male connector 82 and an inclined surface 99*a* is provided in an half-fitting prevention protrusion 99 and in that lock stoppers 96, instead of the lock protrusion stopper 56 (see FIG. 10), are provided at a frontal lower end of an upper slider 95 of a female connector 83.

Accordingly, the same reference numerals as in FIGS. 10 through 12 are given to the same parts having the same purposes in FIGS. 13 and 14, and the detailed description of the configuration and operation of those parts will be omitted. Incidentally, the reason why the lock stoppers 96 are provided in the opposite sides of the frontal lower end of the upper slider 95 is that a space is required for passing the lock arm 98 between the lock stoppers 96.

In the half-fitting prevention connector set 81 configured as described above, there is no lock protrusion provided on the lock arm 98. Because the half-fitting prevention protrusion 99 functions also as the lock protrusion, the height A shown in FIG. 12*a* can be reduced. Further, because the lock member of the male connector 82 is constituted only by the half-fitting prevention protrusion 99, the dimensional accuracy in the direction of the height as required for avoiding the half-fitting prevention stopper 49 of the female connector 83 may be reduced. Further, the fitting state of the female and male connectors 83 and 82 is never released because of the reduced dimensional accuracy, so that not only the size of the connector set can be reduced but also the reliability of the connector set can be improved.

It is a matter of course that the present invention is not limited to the aforementioned embodiments and various modifications may be made. Although the second embodiment has shown, as an example, the case where a level difference is provided at the end of the operation prevention lock 34, the invention can be applied also to the case where even no level difference is provided, if the end of the operation prevention lock 34*b* is designed so as to be locked on the frontal end surface of the shelf portion 36. To give stiffness to the operation prevention lock 34, it is desirable that the operation prevention lock 34 is tapered so that the thickness of the base portion increases gradually as the portion comes to the end portion.

Although the embodiments of the invention have been described about the case where the lock arms 21, 58, and 98 provided in the male connectors 2, 32, 42, and 82 are shaped like a center impeller type, the invention can be applied also to the case where these lock arms are shaped like a cantilever type in order to improve the flexibility of these lock arms in the vertical direction. In this case, the stiffness in the front-rear direction, of the lock arms 21, 58, and 98 is, however, required to be kept necessary and sufficient for the lock of the female and male connectors 3, 2; 33, 32; 43, 42; and 83, 82.

According to the half-fitting prevention connector set configured as described above, when the housing lock presses the lock member in the connector fitting direction against the repulsion force of the elastic member at the time of fitting of the connectors, the repulsion force of the elastic member exceeds the insertion force of the connectors at the point of time when the half-fitting prevention lock runs over the half-fitting prevention lock stopper, so that the lock arm is bent. When the lock member is restored to its original position by using the repulsion force of the elastic member, the connectors are fitted perfectly.

Accordingly, when the hold is released before the half-fitting prevention lock of the lock arm runs over the half-fitting prevention lock stopper, the female and male connectors are disconnected from each other by the repulsion force of the elastic member, so that improper fitting is prevented. Further, when the operation of fitting the connectors to each other is to be carried out, it can be carried out while the side walls of the female housing are gripped because the lock member is covered with the female housing. Accordingly, the workability is improved.

Further, the bending of the lock arm in the half-fitting state is prevented securely by the half-fitting prevention lock and the half-fitting prevention lock stopper, so that the lock arm can be bent only at the time of the perfect-fitting to thereby prevent the half-fitting securely. Accordingly, the reliability is more improved.

Further, even in the case where somewhat external force is applied to the lock arm so that the lock arm is deformed, the connectors cannot be released from the fitting state as long as the lock release member is not operated. Accordingly, a more reliable half-fitting prevention connector set can be provided.

Further, in the perfect-fitting state, the lock member is never moved by unexpected influence of external force because the lock member locks the housing lock and is covered with the female housing. Accordingly, reliability is improved.

Further, when the fitting state of the connectors is to be released, the male housing can be departed easily if the release protrusion is hooked by a finger so that the lock member is moved in the spring compressing direction while the lock arm is pressed. Accordingly, release can be made easily by one operating person, so that the workability is improved.

Further, when the operation prevention lock is provided in the lock member, the lock member is never pressed into the housing by unexpected external force at the time of shipping or at the time of safekeeping with respect to the single female connector. Accordingly, both the breaking of the elastic member and the entering of dust are prevented so that there is no barrier to current conduction. Accordingly, reliability is improved more greatly.

Further, in the half-fitting prevention connector set provided with the above-mentioned upper and lower sliders, the female and male connectors can be released from the perfect-fitting state if the connectors are separated from each other while the lock release protrusion is pressed down. Accordingly, the releasing operation can be carried out more easily by one operating person, so that the workability can be improved more greatly.

Further, because the upper and lower sliders are received as sliding bodies in the housing of the one connector in the perfect-fitting state, the sliders are never moved by unexpected external force. The fitting is not released unless the female and male connectors are separated from each other while the lock release protrusion of the other connector is pressed down artificially. Accordingly, both the safety and reliability can be improved.

Further, in the half-fitting prevention connector set in which there is no lock protrusion provided on the lock arm, the height of the lock protrusion can be shortened because there is no lock protrusion provided on the lock arm. Further, because the lock member of the other connector becomes only the half-fitting prevention protrusion, the dimensional accuracy of the height for avoiding the half-fitting prevention stopper of the other connector can be reduced. That is, the release of the fitting state of the female and male connectors due to low dimensional accuracy never occurs, so that not only the size of the connector set can be reduced but also the reliability of the connector set can be improved.

What is claimed is:

1. An half-fitting prevention connector comprising:

a pair of female and male connectors to be fitted and connected to each other;

an elastic member disposed in a housing of one of said female and male connectors, a repulsion force of said elastic member preventing said female and male connectors from half-fitting to each other;

a lock member disposed in said housing so as to be slidable in a direction of mutual fitting of said female and male connectors for locking the other one of said female and male connector in said housing on the basis of function of said elastic member; and a support mechanism for supporting said lock member so that said lock member is slidable in said housing.

2. An half-fitting prevention connector according to claim 1, wherein said housing has a receiving space provided in the vicinity of a terminal receiving chamber for insertion of connection terminals therein so as to be slidable in the direction of fitting of said connectors for holding said lock member and said elastic member to stop the other one of said female and male connectors, and an opening portion provided as a part of said receiving space for exposing a part of said lock member to the outside.

3. An half-fitting prevention connector according to claim 2, wherein said lock member has a release protrusion for moving said lock member in the direction of mutual fitting of said female and male connectors when the fitting of said connectors is to be released.

4. An half-fitting prevention connector according to claim 1, wherein a housing of said other connector has a flexible lock arm, a housing lock provided on an upper portion of said lock arm so as to be stopped by said lock arm, and an half-fitting prevention lock provided in a side portion of said lock arm whereas the housing of said one connector has an half-fitting prevention lock stopper in the frontal end portion of said receiving space.

5. An half-fitting prevention connector according to claim 2, wherein a housing of said other connector has a flexible lock arm, a housing lock provided on an upper portion of said lock arm so as to be stopped by said lock arm, and an half-fitting prevention lock provided in a side portion of said lock arm whereas the housing of said one connector has an half-fitting prevention lock stopper in the frontal end portion of said receiving space.

6. An half-fitting prevention connector according to claim 2, wherein the bending of said lock arm at the time of fitting of the connectors is suppressed by said half-fitting prevention lock stopper.

7. An half-fitting prevention connector according to claim 4, wherein the bending of said lock arm at the time of fitting of the connectors is suppressed by said half-fitting prevention lock stopper.

8. An half-fitting prevention connector according to claim 2, further comprising:

a tongue-like operation prevention lock which is flexible and turned backward provided under a lower surface of said lock member, an end of said operation prevention lock stopped by a frontal end surface of a shelf portion provided in the housing of said one connector, wherein an upper surface of said shelf portion provided so as to be in the same level as the upper surface of the housing of said other connector to be fitted into said housing.

9. An half-fitting prevention connector set according to claim 4, further comprising:

a tongue-like operation prevention lock which is flexible and turned backward provided under a lower surface of said lock member, an end of said operation prevention lock stopped by a frontal end surface of a shelf portion provided in the housing of said one connector, wherein an upper surface of said shelf portion provided so as to be in the same level as the upper surface of the housing of said other connector to be fitted into said housing.

10. An half-fitting prevention connector set according to claim 1, wherein said lock member includes a lower slider supported in the housing of said one connector so as to be slidable and having said elastic member held in the inside of a rear wall and half-fitting prevention stoppers turned inward in a frontal end portion of opposite side walls, and an upper slider supported by an upper surface of said lower slider so as to be slidable while limited by a slide limiting mechanism, said upper slider having a rear end portion urged forward by said elastic member and having a flexible lock protrusion stopper provided on its front lower end for stopping a lock protrusion on a flexible lock arm provided on said other connector; and half-fitting prevention protrusions are provided on opposite sides of said lock arm of said partner connector.

11. An half-fitting prevention connector set according to claim 1, wherein said lock member includes a lower slider supported in the housing of said one connector so as to be slidable and having said elastic member held in the inside of a rear wall and half-fitting prevention stoppers turned inward in a frontal end portion of opposite side walls, and an upper slider supported by an upper surface of said lower slider so as to be slidable while limited by a slide limiting mechanism and having a rear end portion urged forward by said elastic member and having a lock stopper provided on its front lower end for locking an half-fitting prevention protrusion on a flexible lock arm provided on said other connector.

12. The half-fitting prevention connector of claim 1, wherein said elastic member is a spring.

13. The half-fitting prevention connector of claim 12, wherein said lock member is engaged by said spring such that said spring urges said lock member toward said other connector, said lock member being moveable within said housing over a predetermined stroke extending from a maximum compressed position of said spring to a minimum compressed position.

14. The half-fitting prevention connector of claim 13, wherein said other connector is disposed on a rear side of said one connector and includes a second housing and a flexible lock arm projecting from said second housing, said flexible lock arm having a housing lock projection which abuts against a rear side of said lock member for a beginning portion of said predetermined stroke starting at said minimum compressed position.

15. The half-fitting prevention connector of claim 13, wherein said one housing includes a stopper for preventing deflection of said flexible lock arm during said beginning portion of said predetermined stroke.

16. The half-fitting prevention connector of claim 13, wherein during a latter portion of said stroke, said flexible lock arm is deflectable so that said housing lock projection is deflected out of a path of said lock member so that said lock member is urged to said minimum compressed position of said stroke to lock said other connector in said one connector.

* * * * *